US005860701A

United States Patent [19]

Jungjohann et al.

[11] Patent Number: 5,860,701

[45] Date of Patent: Jan. 19, 1999

[54] SEATING FURNITURE COMPONENT OR THE LIKE WITH A COUPLED BACKREST AND SEAT ADJUSTMENT

[75] Inventors: Thomas Jungjohann, Wiesenstrasse 35, 88521 Ertingen-Binzwangen; Helge Fedderke, Neuss; Christoph Hartmann, Aachen, all of Germany

[73] Assignee: Thomas Jungjohann, Ertingen, Germany

[21] Appl. No.: 917,550

[22] Filed: Aug. 26, 1997

[30] Foreign Application Priority Data

| | | | |
|---|---|---|---|
| Sep. 6, 1996 | [DE] | Germany | 196 36 218.0 |
| Sep. 27, 1996 | [DE] | Germany | 196 39 741.3 |

[51] Int. Cl.[6] ..... A47C 1/02; B60N 2/02

[52] U.S. Cl. ..... 297/316; 297/317; 297/322; 297/340; 297/300.4; 297/300.1; 297/300.2

[58] Field of Search ..... 297/316, 317, 297/322, 300.1, 300.2, 300.4, 340

[56] References Cited

U.S. PATENT DOCUMENTS

| | | | |
|---|---|---|---|
| 3,337,266 | 8/1967 | Burns | 297/317 |
| 3,572,829 | 3/1971 | Malitte | 297/317 |
| 4,078,841 | 3/1978 | Kiang | 297/317 X |
| 4,362,336 | 12/1982 | Zapf et al. | 297/317 |
| 4,452,486 | 6/1984 | Zapf et al. | 297/317 X |
| 4,685,730 | 8/1987 | Linguanotto | 297/340 X |
| 4,732,424 | 3/1988 | Uredat-Neuhoff | 297/300.4 X |
| 5,209,549 | 5/1993 | Chang | 297/322 X |
| 5,251,958 | 10/1993 | Roericht et al. | 297/322 X |
| 5,636,898 | 6/1997 | Dixon et al. | 297/316 |

FOREIGN PATENT DOCUMENTS

| | | | |
|---|---|---|---|
| 2555877 | 6/1985 | France | 297/317 |
| 80 25 516 | 1/1981 | Germany . | |
| 30 33 953 | 5/1981 | Germany . | |
| 93 11 345 | 11/1993 | Germany . | |
| 44 05 653 | 8/1994 | Germany . | |
| 768235 | 2/1957 | United Kingdom | 297/317 |
| 8303957 | 11/1983 | WIPO | 297/340 |

*Primary Examiner*—Jose V. Chen
*Assistant Examiner*—Rodney B. White
*Attorney, Agent, or Firm*—Sixbey, Friedman, Leedom & Ferguson; David S. Safran

[57] ABSTRACT

A seating furniture component with coupled backrest and seat adjustment, having a support chassis (1), a backrest (2) and a seat (3) adjustably attached to the support chassis (1), with the backrest (2) and seat (3) being movably joined to one another in the area of the vertex of the angle between them, the backrest (2) being coupled to a pivot axis (4) on the support chassis (1) at a distance above the vertex of the angle, and the seat (3) being movably attached to the support chassis (1) near the front edge of the seat (3) by a support mechanism (5, 6). The backrest (2) executes a superimposed tiltback and lowering motion from a sitting position into a reclining position, relative to the support chassis (1), while the seat (3) executes a slight superimposed sliding and lifting motion in a synchronized manner. The connection of the backrest (2) to the seat (3), in one embodiment, has two connecting axes on each side which run in two slotted cranks as connecting axis and slotted crank pairs, a first of the connecting axis and slotted crank pairs being located on the rear edge of seat (3), the backrest (2) extending to the rear edge of the seat (3), and the second connecting axis and slotted crank pair being located on the rear edge of seat (3) at a distance above the first pair.

15 Claims, 5 Drawing Sheets

SEATING FURNITURE COMPONENT OR THE LIKE WITH A COUPLED BACKREST AND SEAT ADJUSTMENT

BACKGROUND OF THE INVENTION

1. Field of the Invention

The invention relates to a seating furniture component or the like, especially an upholstered furniture component with coupled backrest and seat adjustment including such sittable reclining furniture as, for example, an upholstered recliner with height-adjustable back part, or a corresponding hospital bed. More specifically, the invention relates to such an upholstered furniture component having a support chassis with a backrest adjustably attached to the support chassis and with a seat adjustable attached to the support chassis, backrest and seat being movably joined to one another in the area of the vertex of the angle between them, the backrest being coupled to a pivot axis on the support chassis at a distance above the vertex of the angle, and the seat being movably attached near the front edge by means of a support mechanism on the support chassis so that the backrest executes a superimposed tiltback and lowering motion from the highest upright position, i.e., the sitting position, into the lowest extended position, i.e., the reclining position, relative to the support chassis and the seat executing slight motion in a synchronized manner from the sitting position to the reclining position, preferably, a superimposed sliding and lifting motion.

2. Description of Related Art

Variously comfortable and complex seating furniture components (armchair, upholstered armchair, easy chair, bus, railroad and aircraft seats, reclining furniture with height adjustable back part), especially upholstered furniture components in which the backrest adjustment and seat adjustment are coupled are known from the prior art. International Application Publication WO 95/25452, which forms the starting point of this invention, provides a good outline of the generally known prior art.

First of all, a seating furniture component is known in which the backrest with the seat forms an angularly-rigid unit which is attached to the support frame to pivot around a pivot axis under the seat such that the backrest tilts back and down when leaning backwards into the reclining position, while the seat swings down at its back end and up at its front end (FIGS. 1 & 2 of WO 95/25452). This movement is normally produced against the force of a return spring. Here, the angularly-rigid connection of the backrest and seat adjustment is uncomfortable, and there is no extended position of the backrest and seat. In addition, it is uncomfortable that the front edge of the seat is moved considerably upward in the reclining position, not being especially salubrious to the legs of the user.

A construction of a seating furniture component is relatively common in which the support chassis is made frame-like with the backrest being pivotally joined to the rear part of the frame-like support chassis a considerable distance above the coupling point of the backrest to the rear edge of the seat (FIGS. 3 & 4 of WO 95/25452). The rear edge of the seat is thus supported by means of the backrest on the support chassis. On or near the front edge, the seat is guided in a slide guide which has only a slight upward tilt, so that the front edge of the seat moves forward, but only slightly upward during the transition from the sitting position into the reclining position.

In the aforementioned system, a user can move into different positions between the sitting position and reclining position relatively easily and without expending a large amount of force by shifting his body weight. However, it is generally necessary to use an additional braking means to be able to maintain a certain desired position.

One disadvantage in the seating furniture component is the result of the pivoting connection of the backrest and the seat roughly at the peak of the angle of the two components. The connection of the two components is structurally simple, but the two components generally carry upholstered supports. The upholstered surfaces of the upholstered supports used by the user are somewhat above the seat or in front of the backrest and thus somewhat above or in front of the pivot axis between the backrest and seat. This results in the fact that, in the transition from the sitting position into the reclining position, the upholstered supports move away from one another results in a so-called "shirt pullout effect" which the user perceives as very unpleasant.

Another problem which is likewise the result of the aforementioned pivot connection at the angle vertex is a "hole" which forms in the pelvis/back area in the transition from the sitting position into the reclining position. This "hole" is disruptive when it is too large, since the pelvis/flank area is then no longer properly supported in the reclining position.

Finally, the attachment of the seat to the front edge must be carefully done so that an overly great blow into the hollows of the knee of the user does not occur in the transition from the sitting position into the reclining position.

Attempts have already been made in the prior art to eliminate the "shirt pullout effect" by providing a connection mechanism, between the backrest and the seat in the area of the rear edge or lower edge, which places the axis of the pivot connection between the backrest and seat, roughly where the surfaces of the two upholstered supports abut one another in the sitting position. This is done by flaps which project on the edge side from the respective frame and which are joined to pivot with one another only on their free ends (FIGS. 5 & 6 of WO 95/25452).

In other seating furniture component, a major advantage is gained over the above-mentioned known seating furniture components by the coupling point of the backrest to the support chassis being located, not above the coupling point of the backrest to the seat, but far below it. This is also done via a lever mechanism, a knee joint connection accomplishing an additional superimposed tilting motion of the backrest. The seat itself is joined to pivot near its front edge on the support chassis at a considerable distance from the coupling point of the backrest to the support chassis. Since this coupling point is near the front edge of the seat, the front edge of the seat, in the transition from the sitting into the reclining position, is raised less than in the seating furniture components known from the prior art.

Analysis of the above explained, known seating furniture component has shown that, as before, the "shirt pullout effect" is noticeable when a relatively extended reclining position is desired. The position change shown in FIGS. 5 and 6 of WO 95/25452 illustrates that only a relatively small tiltback motion of the backrest is possible if a comparatively strong "shirt pullout effect" is to be avoided. In addition, the "hole" in the pelvis/back area is still too large. Finally, the embodiment of the above explained prior art (FIGS. 5, 6), in any case, shows that major lifting of the front edge of the seat takes place. This may be acceptable for a seat with footrests, but this is not the case for a seating furniture component of the type under consideration which generally has no foldable footrest.

SUMMARY OF THE INVENTION

The starting point of this invention is therefore the especially popular version of a seating furniture component explained second above, in which the backrest is connected to pivot on the rear part of the frame-like support chassis at a considerable distance above the coupling point of the backrest to the rear edge of the seat.

Based on this prior art, a primary object of the present invention is to minimize the above explained "shirt pullout effect" and to close the "hole" in the pelvis/back area, such that the pelvis/back area is also effectively supported in the reclining position A particular object of the present invention is to achieve the preceding object by designing the seating furniture so that it results in a small displacement of the hip fulcrum of a user relative to the backrest during the transition from the sitting position into the reclining position in order to thus reduce the "shirt pullout effect".

It is a further object to obtain the preceding objects while preserving the basic principle of the prior art which inherently has the advantage of maximum simplicity.

The aforementioned objects are achieved in a seating furniture component of the type initially mentioned by the features wherein the connection of the backrest to the seat in the area of the vertex of the angle between them has, on each side, two connecting axes which run in two slotted cranks, a first connecting axis and a slotted crank pair being located on the rear edge of the seat, to which the backrest extends, and a second connecting axis and slotted crank pair being located on the rear edge of seat at a distance above first pair.

In developing the present invention, it was determined that, in the sitting position, it is inherent with seating furniture component of the type to which the invention is directed, that the hip of an individual, when sitting correctly, is always roughly in the same position on the seat. Where exactly this position is, of course, depends on different influence factors, for example, the height of the upholstered support, weight of the individual, his body size and build, and gender. For the most part however, it can be stated that the fulcrum of the hips of the user's body will always be located in a relatively narrowly delineated area above the seat and in front of the backrest.

Proceeding from the above explained determination, it was then analyzed how a change in length in the surface of the upholstered support on the backrest relative to the hip fulcrum of the user can be avoided in the transition from the sitting into the reclining position. This change of length is the cause of the above explained "shirt pullout effect". Of course, the user remains sitting on the seat in the transition from the sitting into the reclining position and does not slip forward and back. Consequently, an effort must be made for the back of the user not to change position on the surface of the upholstered support of the backrest or to do so as little as possible.

In addition, however, the simple design of the prior art which forms the point of departure for the invention with the pivot axis for the backrest on the support chassis (continuously or formed by axial sections located on both sides) is fundamentally retained.

According to the teaching of the invention the above described desirable result is achieved by the connection of the backrest to the seat in the area of the vertex of the angle being accomplished, not via a simple swivel joint with a connecting axis, but via a double joint. The connecting mechanism with connecting axes and slotted cranks ensures that the backrest joined to the back end of the seat is shifted forward relative to the seat, towards its front edge, in the transition from the sitting position into the reclining position. The direction of this shift is opposite the direction of the displacement which in the transition from the sitting position into the reclining position leads to the upholstered supports moving away from one another. Because the upholstered supports, in accordance with the invention, do not move apart as dramatically as in the prior art, the upholstered support of the backrests, in the transition from the sitting position into the reclining position, moves above the upholstered support of the seat somewhat forward and up, so that the "hole" which forms in the area of the back and hips is much smaller and can even be largely eliminated, as is optimum for purposes of comfortable sitting.

The design of the invention can be built relatively easily and economically, with the suspension being produced as in the past; therefore, in principle, the support chassis which has long been used for known seating furniture components can continue to be used, and that the coupling points can be well hidden.

The teaching of the invention can be physically executed in different ways, as will be apparent from the following detailed discussion when view together with the accompanying drawings which show, for purposes of illustration, only a few of the embodiments possible in accordance with the present invention.

DETAILED DESCRIPTION OF THE PREFERRED EMBODIMENTS

Since the seating furniture component or the like according to the present invention is, essentially, an improvement of a known seating furniture component which preserves the basic construction of the prior art, to place the present invention in context, first of all, the prior seating furniture component will be explained relative to FIGS. 1 and 2. The illustrated seating furniture component is, generally and in a preferred embodiment, an upholstered furniture component, especially an upholstered chair or part of a multi-seat upholstered couch. However, this should not be construed as meaning that the seating furniture component cannot also be implemented without upholstered supports, for example, as lawn seating furniture of plastic or wood. As was indicated above, the invention relates to seating furniture components in the most general definition thereof as components with a seat and backrest coupled to be positionally adjusted in coordination with each other. Consequently, they can be armchairs, upholstered chairs, easy chairs, as well as bus, railway and aircraft seats, two or three seat sofas, and also reclining furniture on which it is possible to sit, for example, hospital beds having a height adjustable back part or corresponding upholstered recliners.

Figure 1:
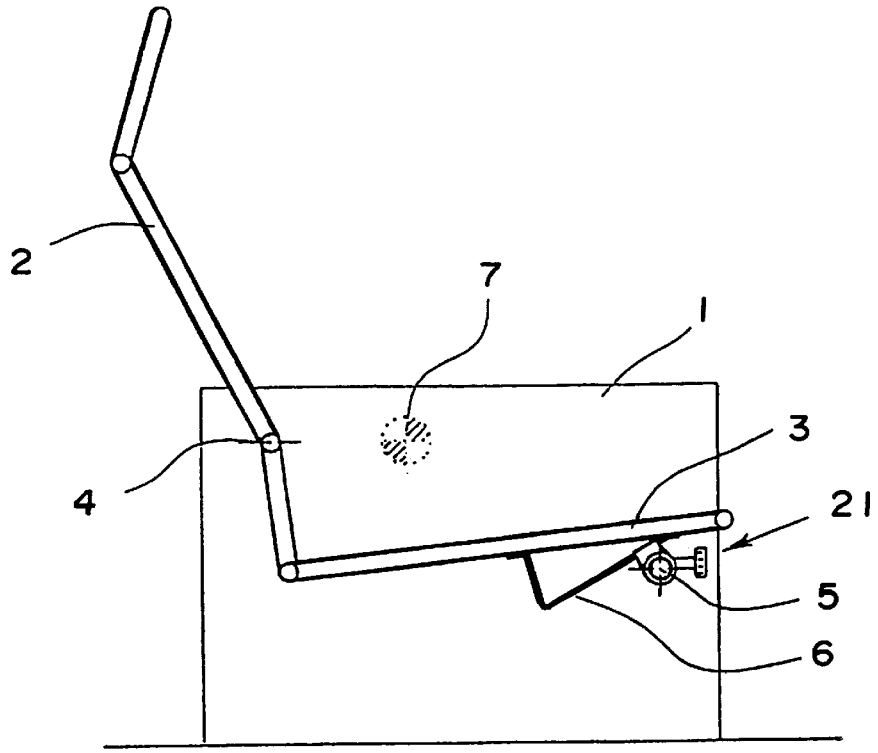
FIG. 1 (PRIOR ART)
FIG. 1 shows one embodiment of a known seating furniture component in the sitting position.
Figure 2:
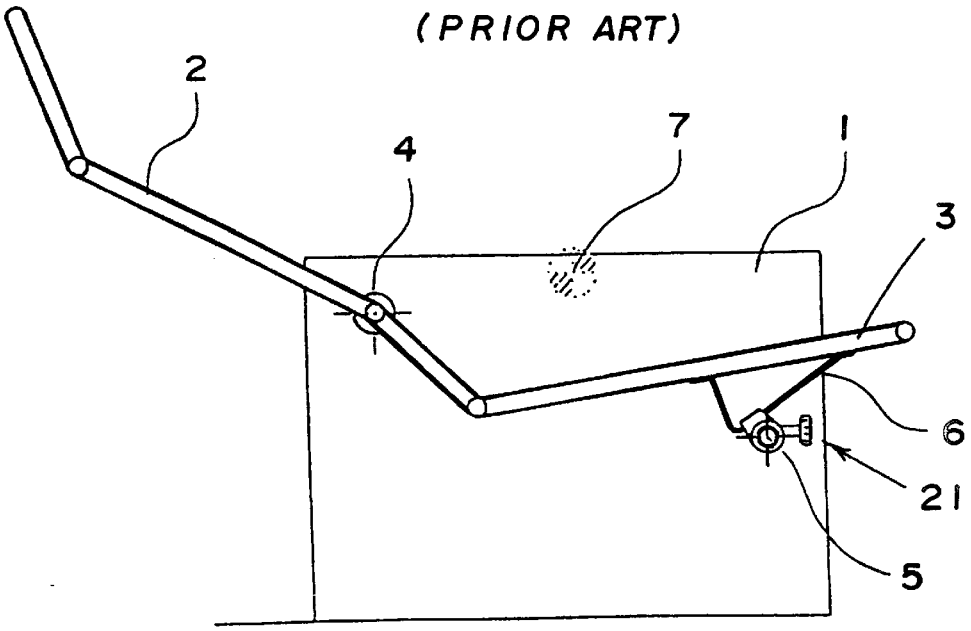
FIG. 2 (PRIOR ART)
FIG. 2 shows the seating furniture component from FIG. 1 in the reclining position.

The seating furniture component shown in FIGS. 1 and 2 has a backrest and seat that are coupled for coordinate adjustment. The backrest 2 and seat 3 can be recognized as being on supported on a chassis 1 of the seating furniture component, executed here as an upholstered chair. Backrest 2 is connected to chassis 1 to pivot about a pivot axis 4, and this pivot axis 4 can be formed a single pivot axis forming member that extends continuous across the width of the chair from side to side or can be formed by separate pivot axis forming members located on each side of the chair, preferably by the latter. Backrest 2 is movably joined to seat 3 in the area of the vertex of the angle by a pivot joint P.

Under the front edge of seat 3, in the support chassis 1, is a crosspiece 5 which bears the seat 3. On the bottom of seat 3 in the area of crosspiece 5 is slide rail 6. More accurately, on the front edge of the seat 3, in the area of crosspiece 5, on each side of the seat there is a slide rail 6. Crosspiece 5 and slide rail 6, together, form a support mechanism for the front edge of seat 3 which allows a sliding and lifting motion of the front edge of the seat 3. It should be pointed out that the sliding and lifting motion of the seat 3, on the front edge, can also be accomplished by a connecting rod guide instead of a slide displacement guide, as is also known in the prior art. In principle, it is also possible to use only one support mechanism 5, 6 on support chassis 1, roughly under the center of the seat 3. This offers additional design possibilities.

Backrest 2, executes a superimposed tiltback and lowering motion relative to support chassis 1 from the highest upright position, i.e., the sitting position, into the lowest extended position, i.e., the reclining position as can be seen from a comparison of FIG. 1 with FIG. 2. At the same time, the seat 3 executes, in a synchronized manner, only a slight movement, specifically the above explained superimposed sliding and lifting motion, from the sitting position into the reclining position. Lifting motion of seat 3, in the transition from the sitting position to the reclining position leads, to the result that the shifting of the user's weight in the attempt to sit upright again is used for pressing seat 3 down by the higher weight of the user and thus again righting backrest 2, optionally supported by a return spring (not shown). That this does not work at all without any displacement of seat 5 in this type of seating furniture components with coupled backrest and seat adjustment is readily apparent.

FIGS. 1 and 2 show hip fulcrum 7 of the body of an average sitting individual. Fulcrum 7 is in a certain position above seat 3 and in front of backrest 2 when the individual is sitting correctly. As has already been explained in the Background part of this specification, hip fulcrum 7 shifts only a little or not at all relative to seat 3 during the transition from the sitting position into the reclining position.

Figure 3:
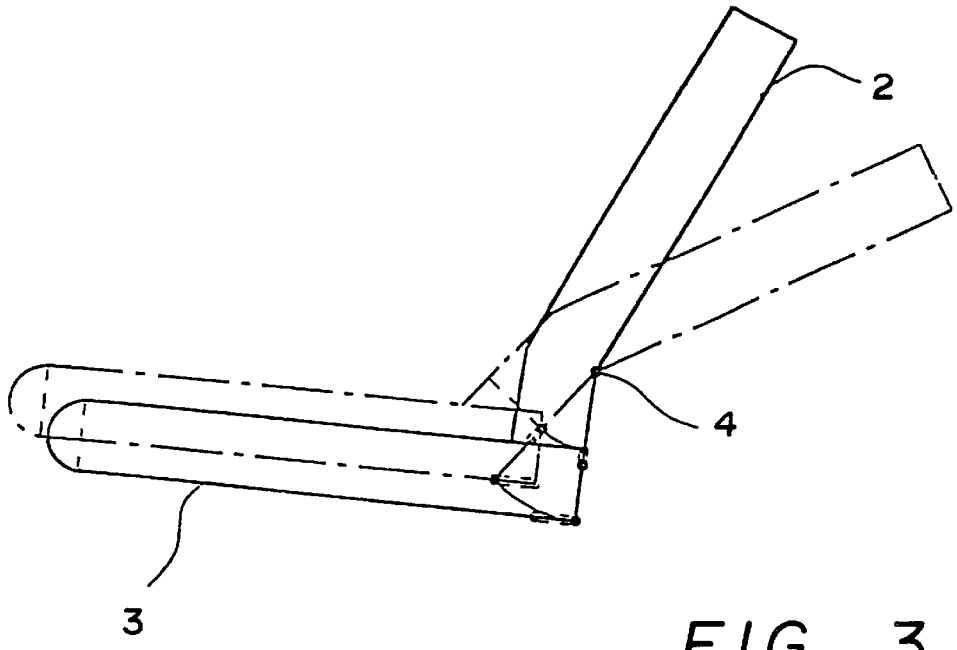
FIG. 3 is a schematic depiction of a seating furniture component according to the present invention, with the sitting position shown in solid lines and the reclining position by a dot-dash lines.
Figure 4:
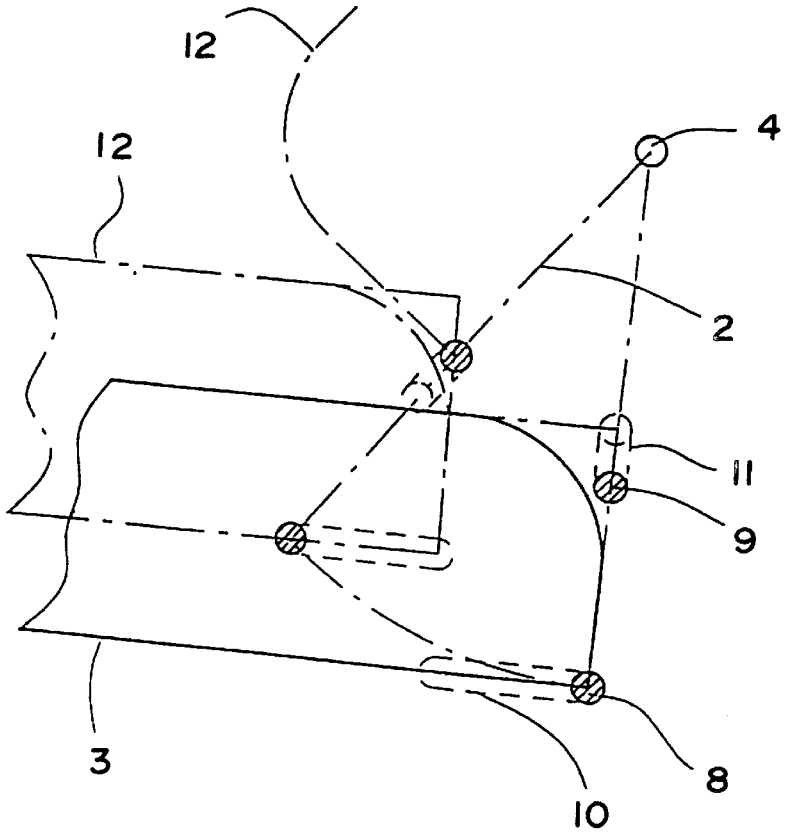
FIG. 4 is an enlarged illustration of the area of the vertex of the angle between the backrest and seat of the embodiment shown in FIG. 3.

As noted, FIGS. 1 & 2 of the drawings show a seating furniture component of the prior art which forms the starting point for the teaching in which the basic concept of the coupling of backrest 2 and the seat 3 effected there is fundamentally maintained. On this basis, FIGS. 3 and 4 show an approach in accordance with a first embodiment of the invention, the position of the backrest 2 and seat 3 in the sitting position being shown there in solid lines and in the reclining position in by dot-dash lines. The connection of the backrest 2 to the seat 3 in the area of the vertex of the angle between them has been essentially changed relative to that of the FIGS. 1 & 2 known arrangement. For the sake of completeness, it is pointed out that, generally, this connection is effected on each side of backrest 2 and seat 3, therefore to the right and left of the backrest 2 and seat 3, or only at one point, especially roughly in the center.

The connection has two connecting axes 8, 9 which run in slotted cranks 10, 11. Here, it is apparent that a first connecting axis 8 and slotted crank 10 pair is located on the rear edge of seat 3 and that the lower end of the backrest 2 extends as far as this connection. It can also be seen that a second connecting axis 9 and slotted crank 11 pair is located on the rear edge of seat 3 at a distance above the first pair 8, 10. The representation in FIG. 3 makes it especially clear that the backrest 2 is shifted more strongly to the front underneath pivot axis 4, during the transition from the sitting position to the reclining position, than is the seat 3. The resulting relative movement between the lower edge of backrest 2 and seat 3 is accommodated by the first pair formed by the connecting axis 8 and slotted perforated crank 10. The "shirt pullout effect" is clearly reduced and the "hole" in the pelvis area which occurs in the transition to the reclining position is reduced to a comfortable degree.

The sitting position and reclining position are defined by the end positions of connecting axes 8, 9 in slotted cranks 10, 11.

FIG. 4 illustrates that, preferably, a certain position for the second pair 9, 11 entails an especially beneficial effect. The second connecting axis and slotted crank pair 9, 11 is located, in this embodiment, roughly at the center of the distance between the pivot axis 4 and the first axis and crank pair 8, 10. If, as shown, the first axis and crank pair 8, 10 is located roughly on the bottom of seat 3, furthermore, it is recommended that second axis and crank pair 9, 11 be located roughly at the height of the top of the upholstered support 12 on seat 3.

In the embodiment shown, it can be recognized that the upholstered supports 12 on the backrest 2 and seat 3 are roughly the same thickness. FIG. 4 shows how the front of upholstered support 12 on backrest 2 is displaced above the back end of upholstered support 12 of seat 3 during the transition into the reclining position, and thus, supports the lumbar area of the user.

The assignment of the connecting axes and slotted cranks to the two interconnected parts, specifically backrest 2 and seat 3, can essentially be freely determined. However, in the embodiment shown, the first connecting axis 8 is located on backrest 2 and the first slotted crank 10 on seat 3, while the second connecting axis 9 is located on seat 3 and the second slotted crank 11 on backrest 2. The second connecting axis and slotted crank pair 9, 11 is used essentially to compensate for the motion of backrest 2 and seat 3 relative to one another which results from the displacement of connecting axis 8 in slotted crank 10.

The embodiment shown in FIGS. 3 and 4 has crank 10 running in a straight line and aligned roughly parallel to the plane of seat 3. This corresponds to the fact that the second slotted crank 11 runs in a straight line and is preferably aligned in the sitting position roughly perpendicular to the plane of seat 3. However, is also possible to orient the slotted crank 10 inclined relative to the plane of seat 3, rising from the back to the front end. This inclined position leads to an altered motion of backrest 2 relative to seat 3 depending on the desired application, but also depending on the configuration and upholstering of backrest 2 and seat 3.

FIG. 3 shows, in broken lines at the front edge of seat 3, the inclined position of corresponding slide rail 6 which is part of the support mechanism. This incline can be roughly 40° with respect to the ground; the angle of inclination should be selected such that a user does not feel the front edge of seat 3 pressed too strongly into the hollows of his/her knees during the transition into the reclining position. A certain lift there is pleasant, but too much is unpleasant. The displacement on the front edge of seat 3, otherwise, largely follows the shape of the connecting area at the vertex of the angle.

Figure 7:
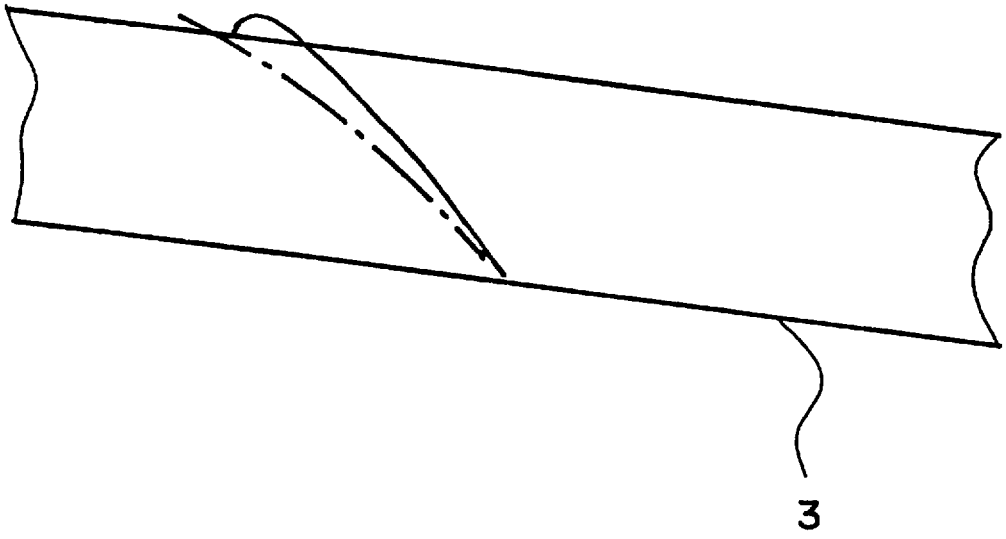
FIG. 7 shows a front edge area of a seat of a seating furniture component in accordance with the present invention.

FIG. 7 shows the area of the front edge of seat 3 in a schematic view in which the shifting of a particular point on the front edge of seat 3 is traced during the transition from the sitting into the reclining position. The solid line shows the shifting of this point in the embodiment with straight slotted crank 10 as shown in FIGS. 3, 4. Here, a bend is shown in this curve which occurs shortly before the reclining position is reached; it is known from practice that this point is roughly 5° before the reclining position is reached. This effect is known to be disagreeable to the user of the seating furniture component known from the prior art as "tilting".

Figure 5:
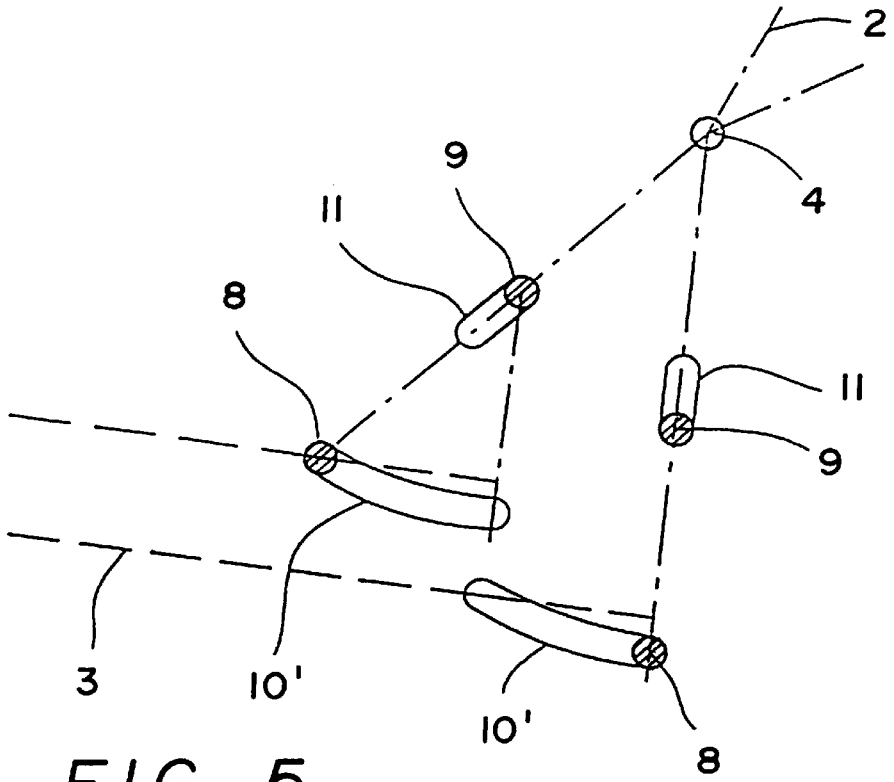
FIG. 5 is a view corresponding to that of FIG. 4 but showing another embodiment with a different crank guide.
Figure 6:
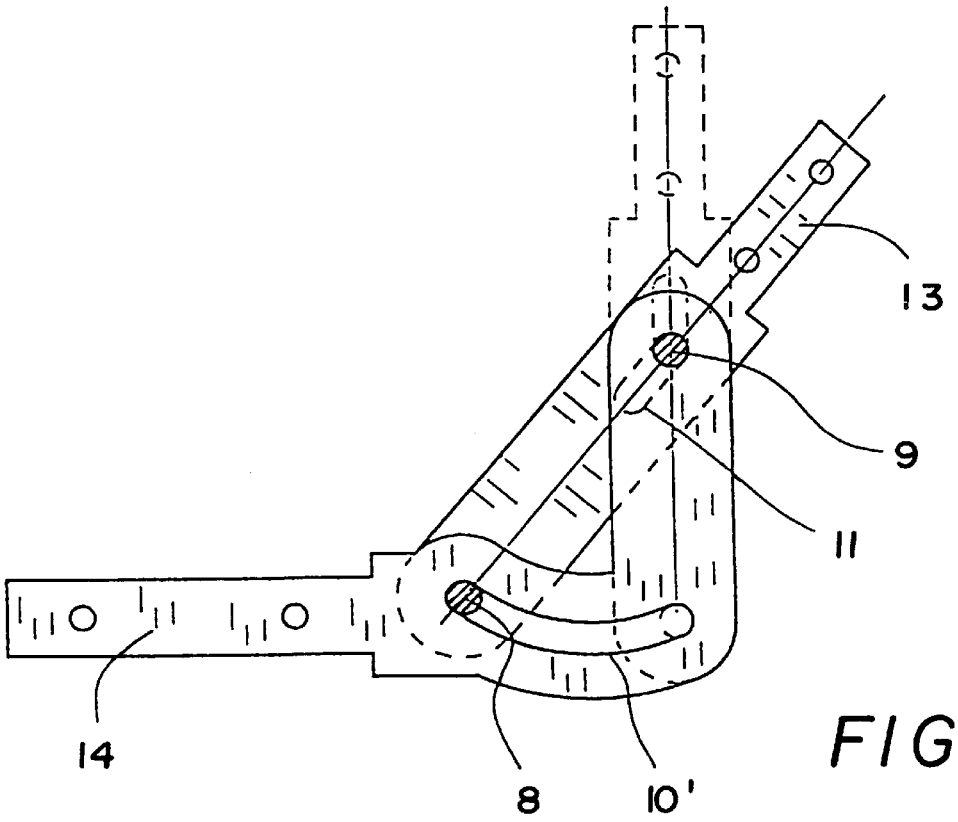
FIG. 6 shows a brace which physically implements the crank guide of FIG. 5.

FIGS. 5 and 6 show an embodiment in which the above explained "tilting" effect no longer occurs or at least essentially no longer occurs. This is achieved according to the embodiment in FIGS. 5 and 6 by the first slotted crank having a slot which is concavely curved, and according to a preferred teaching shown here, is curved in circular arc shape. The location of slotted crank 10' having such a concavely curved slot is dictated by the pivoting-sliding motion of the connecting axis 9 with reference to the slotted crank 11 and the desired shifting of backrest 2. Tests have shown that it is a good idea to have the concavely curved slotted crank 10' run not quite parallel to the lower edge of seat 3, but, as shown, to provide for the rear end of slotted crank 10' on the bottom rear edge of seat 3 to be lower than the front end thereof which is directed towards the front edge of seat 3. The embodiment shown, furthermore, illustrates that, in the design chosen here, the radius of the circular arc of the arc-shaped concave slot of crank 10' corresponds roughly to the distance between the two connecting axes 8, 9 in the sitting position or is slightly less than this distance. Here, of course, there are broad possibilities for variation. Basically, further optimization by an S-shaped crank or by a concavely curved crank in combination with a concavely curved crank of a different radius or part of a straight crank would also be possible.

FIG. 7 shows where the special advantage of the concavely curved slot of crank 10' of the embodiment of FIGS. 5 & 6 lies. The broken line in FIG. 7 shows the behavior of the corresponding point when crank 10' with the concavely curved slot is used. Here, it is shown that the source of the "tilting effect" is essentially eliminated, resulting in a uniform, pleasant motion of backrest 2 when sitting up from the reclining position.

FIG. 6 shows that the parts assigned to backrest 2, therefore especially first connecting axis 8 and second slotted crank 11 are combined in a backrest brace 13. Accordingly the parts assigned to seat 3, especially therefore, the second connecting axis 9 and first slotted crank 10, are combined in a seat brace 14. Backrest brace 13 and seat brace 14, in the embodiment shown, are connected to one another to form a single, manageable part which can be surrounded by a housing (not shown). It should be recognized that this overall brace is located on the left and on the right sides of the support chassis 1, preferably two mirror-symmetrical overall braces being used. A single overall brace located in the center between backrest 2 and seat 3 or two individual braces, i.e., a backrest brace and a seat brace, roughly in the middle between the backrest 2 and the seat 3 would also be fundamentally possible.

The embodiment in FIG. 3, furthermore, illustrates that in this concept as well backrest 2 is bent rearwardly roughly at the height of the pivot axis 4; this causes a correspondingly comfortable reclining position.

When the individual distances and radii are appropriately dimensioned, the upholstered support 12 on the backrest 2 and seat 3 can be made continuous and the lateral overall brace(s) largely hidden therein.

So that guiding of connecting axes 8, 9 in slotted cranks 10 (10'), 11 takes place with little friction, it is possible to appropriately round the edges of the slotted cranks 10 (10'), 11, to provide them with slide coatings or slide inserts or to treat their surfaces in some other way. It can also be visualized how it is possible for the connecting axes 8, 9, themselves, to be made as rollers which run in slotted cranks 10 (10'), 11 to further reduce friction.

Figure 8:
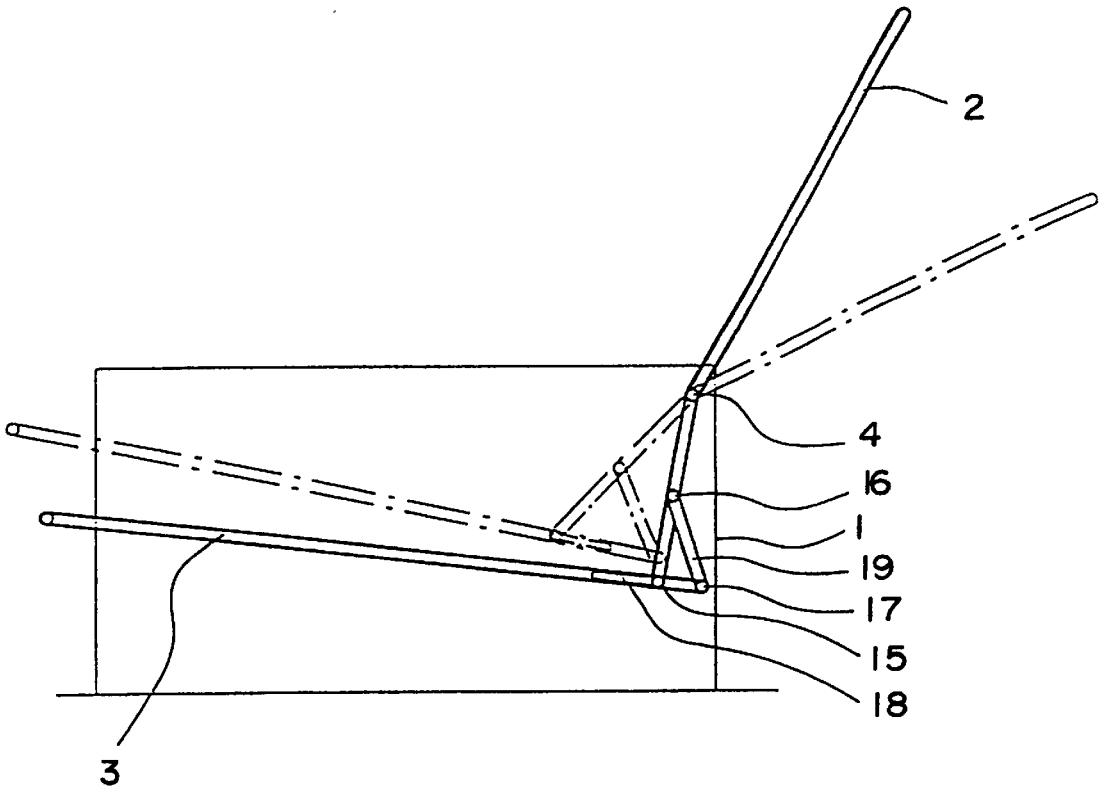
FIG. 8 shows another embodiment of a seating furniture component in accordance with the present invention with the sitting position shown in solid lines and the reclining position by dot-dash lines.

FIG. 8 shows an alternative approach to a likewise functionally shaped seating furniture component which reduces the "shirt pullout effect" and in which the aforementioned reference numbers have been used to designation corresponding parts. To this extent repeated explanations of these parts are unnecessary.

As an alternative, it is provided that the connection of backrest 2 to seat 3 in the area of the vertex of the angle has, on each side, three connecting axes 15, 16, 17 and one slotted crank 18. The first connecting axis 15 runs in the slotted crank 18 and this pair 15, 18 is located in front of the rear edge of seat 3. The second connecting axis 16 is located on the backrest 2 at a distance above pair 15, 18, and the third connecting axis 17 is on the rear edge of seat 3. The second connecting axis 16 and third connecting axis 17 are joined to one another via an auxiliary connecting rod 19.

The representation of the sitting position in solid lines and the reclining position in broken lines indicates the operation of the auxiliary connecting rod 19. Seat 3 is drawn away from the backrest 2 in the transition into the reclining position as connecting axis 15 moves away from connecting axis 17 in the slot of crank 18, and as a result, some of the displacement of the backrest 2 which causes the "shirt pullout effect" relative to the seat is thus canceled or compensated.

Figure 9:
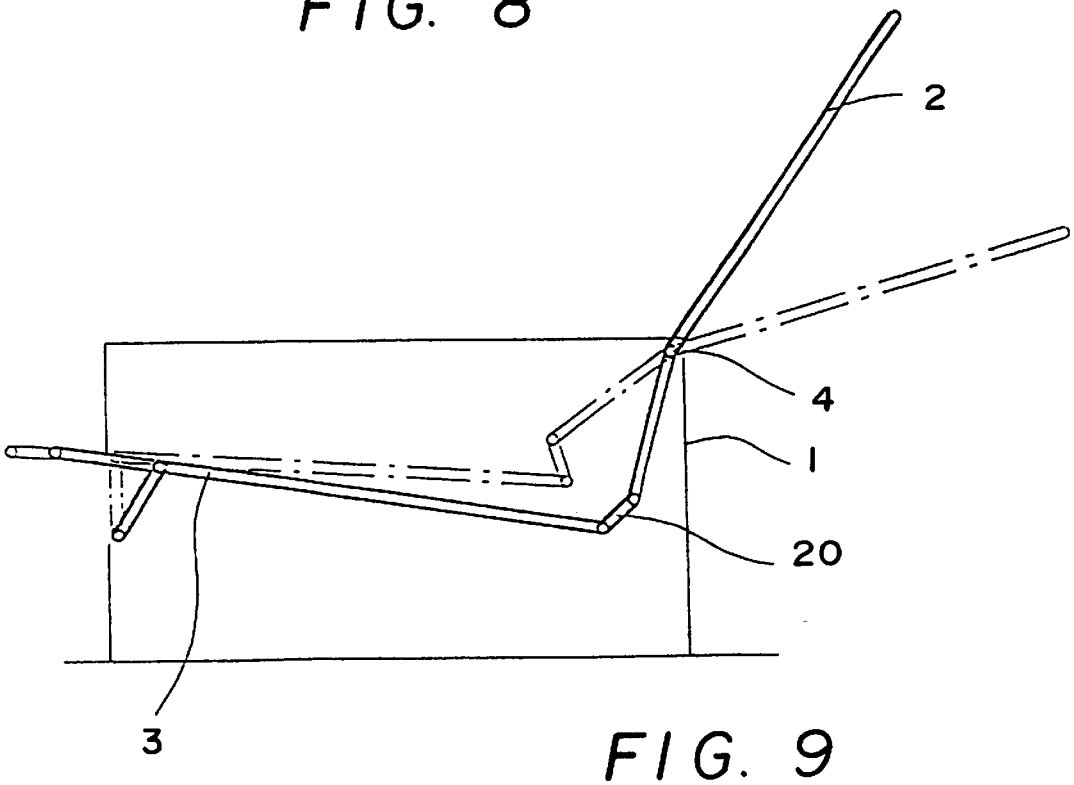
FIG. 9 is a view similar to that of FIG. 8 showing a fourth embodiment of a seating furniture component in accordance with the present invention.

Finally, FIG. 9 shows an embodiment with another version in which it is provided that the connection of the backrest 2 to the seat 3, in the area of the vertex of the angle on each side, is accomplished via an auxiliary connecting rod 20 which is pivotally connected on both ends between the lower end of the backrest 2 and the rear end of the seat 3. This auxiliary connecting link 20 forms a connection similar to a knee joint between backrest 2 and seat 3 and allows a pendulum motion of seat 3 during the transition into the reclining position; this likewise, as FIG. 9 shows, partially compensates for the displacement of backrest 2 relative to seat 3. Also in FIG. 9, a further pivot link is shown guiding and supporting the front edge portion of seat 3 instead of, for example, the support mechanism as used in the prior art formed of slide rail 6 and crosspiece 5.

At the start of this Detailed Description, reference was made to FIGS. 1 & 2 and to the fact that the front edge of seat 3 is supported on crosspiece 5 by means of slide rail 6. Known braking means 21 is shown there which allows a defined braking effect to be established so that the motion of the seating furniture component between the sitting position and the reclining position can be sensitively adjusted or individual positions can also be established. Such a braking means 21 or an equivalent alternative should, of course, also be implemented in the seating furniture component of the present invention, for which reference may be made to the prior art or commonly owned, co-pending U.S. patent application Ser. No. 08/917,934, entitled "Braking Means For a Movable Part of a Furniture Component, Especially an Upholstered Furniture Component" and which claims priority based upon German Patent Application Nos. 19634807.2 and 19638075.8.

The concept of a seating furniture component, especially an upholstered furniture component, generally includes, as specific products, chairs, armchairs, easy chairs, and also multi-seat upholstered furniture which then has the aforementioned adjustability in each individual seat. These seating furniture components also encompass, for example, aircraft seats or seats in comfortable touring busses or other means of transportation. These seating furniture components can also be used for other rest areas.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Seating furniture component with coupled backrest and seat adjustment, comprising:

a support chassis;

a backrest adjustably attached to the support chassis;

a seat adjustably attached to support chassis;

wherein the backrest and seat are movably connected to one another by a connection in an area of a vertex of an angle formed between them, the backrest being coupled to a pivot axis on the support chassis at a distance above said vertex and a front edge of the seat being movably attached to the support chassis by means of support mechanism in a manner producing a synchronous adjustment of the backrest and seat, the backrest executing a superimposed tiltback and lowering motion relative to the support chassis from a highest upright sitting position, into a lowest extended reclining position and the seat executing a slight motion from the sitting position to the reclining position;

wherein the connection of backrest to the seat in the area of the vertex of the angle has two connecting axes which run in two slotted cranks on each side as connecting axis and slotted crank pairs of which a first connecting axis and slotted crank pair is located on a rear edge of the seat, the backrest extending to the said rear edge, and a second connecting axis and slotted crank pair is located on the rear edge of seat at a distance above the first connecting axis and slotted crank pair; and wherein the second connecting axis and slotted crank pair is located roughly at a center of a distance between the pivot axis on the support chassis to which the backrest is coupled and said first connecting axis and slotted crank pair.

2. Seating furniture component as claimed in claim 1, wherein the first connecting axis and slotted crank pair is located on a bottom of the seat.

3. Seating furniture component as claimed in claim 2, wherein the slotted crank of the first connecting axis and slotted crank pair has a slot which runs in a straight line roughly parallel to a top surface of the seat.

4. Seating furniture component as claimed in claim 2, wherein the slotted crank of the first connecting axis and the slotted crank pair have a slot which is concavely curved and is lower at a back end thereof which is located on a bottom edge of seat than on a front end thereof.

5. Seating furniture component as claimed in claim 2, wherein an upholstered support is provided on the seat; wherein the second connecting axis and slotted crank pair is located roughly at a height of a top of the upholstered support on the seat.

6. Seating furniture component as claimed in claim 5, wherein the slotted crank of the second connecting axis and slotted crank pair has a slot which runs in a straight line roughly perpendicular to a top surface of the seat in the sitting position.

7. Seating furniture component as claimed in claim 6, wherein the slotted crank of the first connecting axis and slotted crank pair has a slot which is concavely curved and is lower at a back end thereof which is located on a bottom edge of seat than on a front end thereof.

8. Seating furniture component as claimed in claim 1, wherein an upholstered support is provided on the seat; wherein the second connecting axis and slotted crank pair is located roughly at a height of a top of the upholstered support on the seat.

9. Seating furniture component as claimed in claim 8, wherein the slotted crank of the second connecting axis and slotted crank pair has a slot which runs in a straight line roughly perpendicular to a top surface of the seat in the sitting position.

10. Seating furniture component as claimed in claim 1, wherein the slotted crank of the first connecting axis and slotted crank pair has a slot which runs in a straight line roughly parallel to a top surface of the seat.

11. Seating furniture component as claimed in claim 1, wherein the slotted crank of the second connecting axis and slotted crank pair has a slot which runs in a straight line roughly perpendicular to a top surface of the seat in the sitting position.

12. Seating furniture component as claimed in claim 11, wherein the slotted crank of the first connecting axis and slotted crank pair has a slot which is concavely curved and is lower at a back end thereof which is located on a bottom edge of seat than on a front end thereof.

13. Seating furniture component as claimed in claim 1, wherein the slotted crank of the first connecting axis and the slotted crank pair have a slot which is concavely curved and is lower at a back end thereof that is located in a bottom edge of the seat than on a front end thereof.

14. Seating furniture component with coupled backrest and seat adjustment, comprising:

a support chassis;

a backrest adjustably attached to the support chassis;

a seat adjustably attached to support chassis;

wherein the backrest and seat are movably connected to one another by a connection in an area of a vertex of an angle formed between them, the backrest being coupled to a pivot axis on the support chassis at a distance above said vertex and a front edge of the seat being movably attached to the support chassis by means of support mechanism in a manner producing a synchronous adjustment of the backrest and seat, the backrest executing a superimposed tiltback and lowering motion relative to the support chassis from a highest upright sitting position, into a lowest extended reclining position and the seat executing a slight motion from the sitting position to the reclining position;

wherein the connection of backrest to the seat in the area of the vertex of the angle has two connecting axes which run in two slotted cranks on each side as connecting axis and slotted crank pairs of which a first connecting axis and slotted crank pair is located on a rear edge of the seat, the backrest extending to the said rear edge, and a second connecting axis and slotted crank pair is located on the rear edge of seat at a distance above the first connecting axis and slotted crank pair; and wherein the slotted crank of the first connecting axis and slotted crank pair has a slot which is concavely curved and is lower at a back end thereof which is located on a bottom edge of seat than on a front end thereof.

15. Seating furniture component with coupled backrest and seat adjustment, comprising:

a support chassis;

a backrest adjustably attached to the support chassis;

a seat adjustably attached to support chassis;

wherein the backrest and seat are movably connected to one another by a connection in an area of a vertex of an angle formed between them, the backrest being coupled to a pivot axis on the support chassis at a distance above said vertex and a front edge of the seat being movably attached to the support chassis by means of support mechanism in a manner producing a synchronous adjustment of the backrest and seat, the backrest executing a superimposed tiltback and lowering motion relative to the support chassis from a highest upright sitting position, into a lowest extended reclining position and the seat executing a slight motion from the sitting position to the reclining position;

wherein the connection of the backrest to the seat in the area of the vertex of the angle has three connecting axes and one slotted crank on each side; wherein a first of the connecting axes runs in the slotted crank and forms a connecting axis and slotted crank pair with the slotted crank, said connecting axis and slotted crank pair being located in front of a rear edge of the seat; wherein a second of the connecting axes is located on the backrest at a distance above the connecting axis and slotted crank pair; wherein a third of the connecting axes is located on the rear edge of the seat; and wherein the second connecting axis and the third connecting axis are interconnected via an auxiliary connecting rod.

* * * * *